US008562294B2

(12) United States Patent
Gouda et al.

(10) Patent No.: US 8,562,294 B2
(45) Date of Patent: Oct. 22, 2013

(54) SEALING ARRANGEMENT FOR USE WITH GAS TURBINE ENGINE

(75) Inventors: Makoto Gouda, Himeji (JP); Yoshihiro Yamasaki, Kobe (JP)

(73) Assignee: Kawasaki Jukogyo Kabushiki Kaisha (JP)

( * ) Notice: Subject to any disclaimer, the term of this patent is extended or adjusted under 35 U.S.C. 154(b) by 473 days.

(21) Appl. No.: 12/896,356

(22) Filed: Oct. 1, 2010

(65) Prior Publication Data

US 2011/0085888 A1 Apr. 14, 2011

(30) Foreign Application Priority Data

Oct. 14, 2009 (JP) ..... 2009-236901

(51) Int. Cl.
*F01D 5/08* (2006.01)
*F01D 11/00* (2006.01)

(52) U.S. Cl.
USPC ..... 416/96 R; 416/219 R; 415/110

(58) Field of Classification Search
USPC ..... 416/97 R, 96, 219 R; 415/110
See application file for complete search history.

(56) References Cited

U.S. PATENT DOCUMENTS 1,651,503 A 12/1927 Belluzzo
2,931,623 A 4/1960 Hyde
4,424,668 A * 1/1984 Mukherjee ..... 60/39.182
4,725,200 A * 2/1988 Welhoelter ..... 416/221
5,160,243 A 11/1992 Herzner et al.
6,485,255 B1 * 11/2002 Care et al. ..... 415/12

FOREIGN PATENT DOCUMENTS

| | | |
|---|---|---|
| DE | 196 44 543 A1 | 4/1998 |
| EP | 0 860 586 A2 | 8/1998 |
| EP | 1 283 328 A1 | 2/2003 |
| JP | A-7-247804 | 9/1995 |
| JP | A-11-022408 | 1/1999 |
| JP | A-2000-274261 | 10/2000 |

OTHER PUBLICATIONS

European Search Report issued in European Patent Application No. 10187384.2 dated Oct. 17, 2011.

* cited by examiner

*Primary Examiner* — Nathaniel Wiehe
*Assistant Examiner* — Justin Seabe
(74) *Attorney, Agent, or Firm* — Studebaker & Brackett PC

(57) ABSTRACT

A sealing member has a first portion. The first portion has a central axis, a first peripheral surface extending in a direction parallel to the central axis, and a central aperture. A first wall portion of a groove has a recess communicated with the first opening of the first channel. The recess has a second peripheral surface complementary to the first peripheral surface of the first portion of the sealing member. The first portion of the sealing member moves radially toward and away from the rotational axis as the first peripheral surface of the sealing member defines and maintains a first sealing contact with the second peripheral surface of the recess. The sealing member moves radially outwardly and thereby makes a second sealing contact surrounding the second opening of the second channel to establish a communication between the first and second openings.

4 Claims, 6 Drawing Sheets

SEALING ARRANGEMENT FOR USE WITH GAS TURBINE ENGINE

FIELD OF THE INVENTION

The present invention relates to a sealing arrangement for use with, for example, a gas turbine engine having at least one turbine disk and blade members mounted on a circumferential portion of the turbine disk, for preventing or minimizing leakage of cooling medium from gaps between the turbine disk and the blade members.

BACKGROUND OF THE INVENTION

FIG. 6 is partial cross section of a conventional gas turbine engine generally indicated by reference numeral 100, showing a connection between a turbine disk generally indicated by reference numeral 101 and a blade member generally indicated by reference numeral 102. As shown, the turbine disk 101 has a circumferential surface 103 extending in a rotational direction 104 about a rotational axis of the engine 100 (not shown). The circumferential surface 103 has a plurality of grooves 105 defined therein at regular intervals in the rotational direction 104. The grooves 105 are extended in a direction substantially parallel to the rotational axis.

For example, the groove 105 has a cross section defined by a pair of opposed side walls 106 and a bottom wall 107 connecting the side walls 106. In particular, the side walls 106 are corrugated symmetrically to have two inwardly facing portions 108*a* and 108*b* diverging from the circumferential surface 103 toward the rotational axis. The blade member 102 has a blade 109 and a root 110 integrally formed therewith. The root 110 has a configuration which is substantially complementary to that of the groove 105, so that the blade member 102 is assembled on the turbine disk 101 with its root 110 fitted or engaged within the groove 105.

This arrangement needs small gaps 111 or clearance between the groove walls and the root walls in order to facilitate the assembling or sliding engagement of the root 110 into the groove 105, which disadvantageously induces an unwanted leakage of cooling medium or air 112 supplied through air channels 113 and 114 defined in the turbine disk 101 and blade member 102, respectively, for cooling the blade 109 and thereby increasing a heat durability of the blade 109 against high temperature combustion gas. In the illustrated arrangement, the outlet opening of the channel 113 in the turbine disk 101 is opened at a bottom wall portion 115 of the groove 105 and the inlet opening of the channel 114 in the blade member 102 is opened at an opposing bottom wall portion 116 of the root 110 so that the cooling air 112 supplied from a source (not shown) is delivered through the channels 113 and 114 into a cooling chamber or passages defined in the blade 109 (not shown) for its cooling. During the air supply, the cooling air 112 disadvantageously flows in part into the gaps 111 to be eventually wasted into the turbine chamber 117, which in turn degrades the cooling efficiency of the blade 109.

One technique which may be used for solving this problem is disclosed in the U.S. Pat. No. 5,160,243. According to this technique, a metallic reinforced shim is mounted in the gap between the turbine disk and the blade member to cover the pair of diverging side walls and the bottom wall of the root so that the portions of the shim covering the side walls are tightly nipped by the side walls of the root and the opposing side walls of the groove due to centrifugal force caused by the rotations of the turbine disk.

This technique may also be applied for sealing the gaps 111 around the opposed openings of the cooling air channels 113 and 114. For example, as shown in FIG. 6, a plate-like shim 118 with an aperture 119 may be provided in the gap 111 between the opposed bottom walls 115 and 116 of the turbine disk 101 and the root 109 so that the opposed openings of the channels 112 and 113 are fluidly communicated through the aperture 116, allowing the cooling air 112 to flow from one channel 113 through the aperture 119 into the other channel 114.

This arrangement, however, has drawbacks. For example, if a thickness of the shim 118 is designed to be smaller in order to facilitate the insertion or positioning of the shim 118 into the gap 111, the shim 118 is firmly forced on the bottom wall 116 of the root 110 due to the centrifugal force caused by the rotations of the turbine disk 101 to cause another gap (not shown) between bottom wall 115 of the groove 105 and the opposed outer surface (i.e., lower surface in FIG. 6) of the shim 118, still allowing the leakage of the cooling air 112. If on the other hand the thickness of the shim 118 is designed to be substantially the same as or slightly larger than the gap 111, the assembling or insertion of the shim 118 will become significantly difficult. Also, if the shim is inserted forcedly, it may buckle within the gap to cause a misalignment of the aperture, which results in that the channels are in part blocked by the shim.

Therefore, according to the above-described techniques, in order to enhance the cooling efficiency and the assembling, it is necessary to machine the shim with a high degree of precision, which results in a drastic increase of the manufacturing cost of the shim. Also, the size of the gap may vary significantly due to the dimensional tolerances of the turbine disk and the blade member, so that the high precision machining of the shim may be of useless. Further, a fixing means may also be needed to hold the shim in position in the gap.

SUMMARY OF THE INVENTION

Therefore, it is an object of the present invention to provide an improved sealing arrangement mounted between the turbine disk and the blade member, which effectively prevents the cooling from leaking through the gap therebetween.

In order to achieve the foregoing object, the present invention provides an arrangement for use with a gas turbine engine. The engine has a rotational axis, a turbine disk supported for rotation about the rotational axis, and a blade member detachably mounted in a groove defined in a circumferential portion of said disk. The groove has an inwardly enlarged portion. The blade member has a root complementary to said enlarged portion so as to fit into said groove. The disk and the blade have first and second channels fluidly communicated to each other through first and second openings defined in radially opposed first and second wall portions of the groove and said root.

The arrangement has a sealing member. The sealing member has a first portion. The first portion has a central axis, a first peripheral surface extending in a direction parallel to the central axis, and a central aperture extending in the central axis.

The first wall portion of the groove has a recess defined therein and fluidly communicated with the first opening of the first channel. The recess has a second peripheral surface complementary to the first peripheral surface of the first portion of the sealing member for receiving the first portion of the sealing member.

This arrangement allows that the first portion of the sealing member moves radially toward and away from the rotational axis as the first peripheral surface of the sealing member defines and maintains a first sealing contact with the second peripheral surface of the recess.

When a centrifugal force is applied to the sealing member, the sealing member moves radially outwardly to abut the second wall portion of the root and thereby makes a second sealing contact surrounding the second opening of the second channel to establish a sealed fluid communication between the first and second openings through the aperture.

According to the invention, the sealing member maintains the first sealing contact with the turbine disk. When the turbine disk is rotated, the sealing member is forced radially outwardly by the centrifugal force applied thereto to make the second sealing contact with the blade. This causes the sealed fluid communication between the first and second channels to ensure that the cooling medium is delivered from the first channel into the second channel without leaking into the gap between the turbine disk and the blade, which attains an improved cooling of the blade and increases a durability of the blade.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following descriptions of the preferred embodiments are merely exemplary in nature and are in no way intended to limit the invention, its application, or uses.

Hereinafter, preferred embodiments of the present invention will be described with reference to the accompanying drawings. Although not limited thereto, the sealing arrangement according to the present invention is preferably used with, for example, gas turbine engines. Typically, the gas turbine engine has a compressor for compressing air, one or more combustors for combusting fuel with the compressed air, and a turbine which is driven by the high-temperature and high-pressure combustion gas from the combustors.

Figure 1:
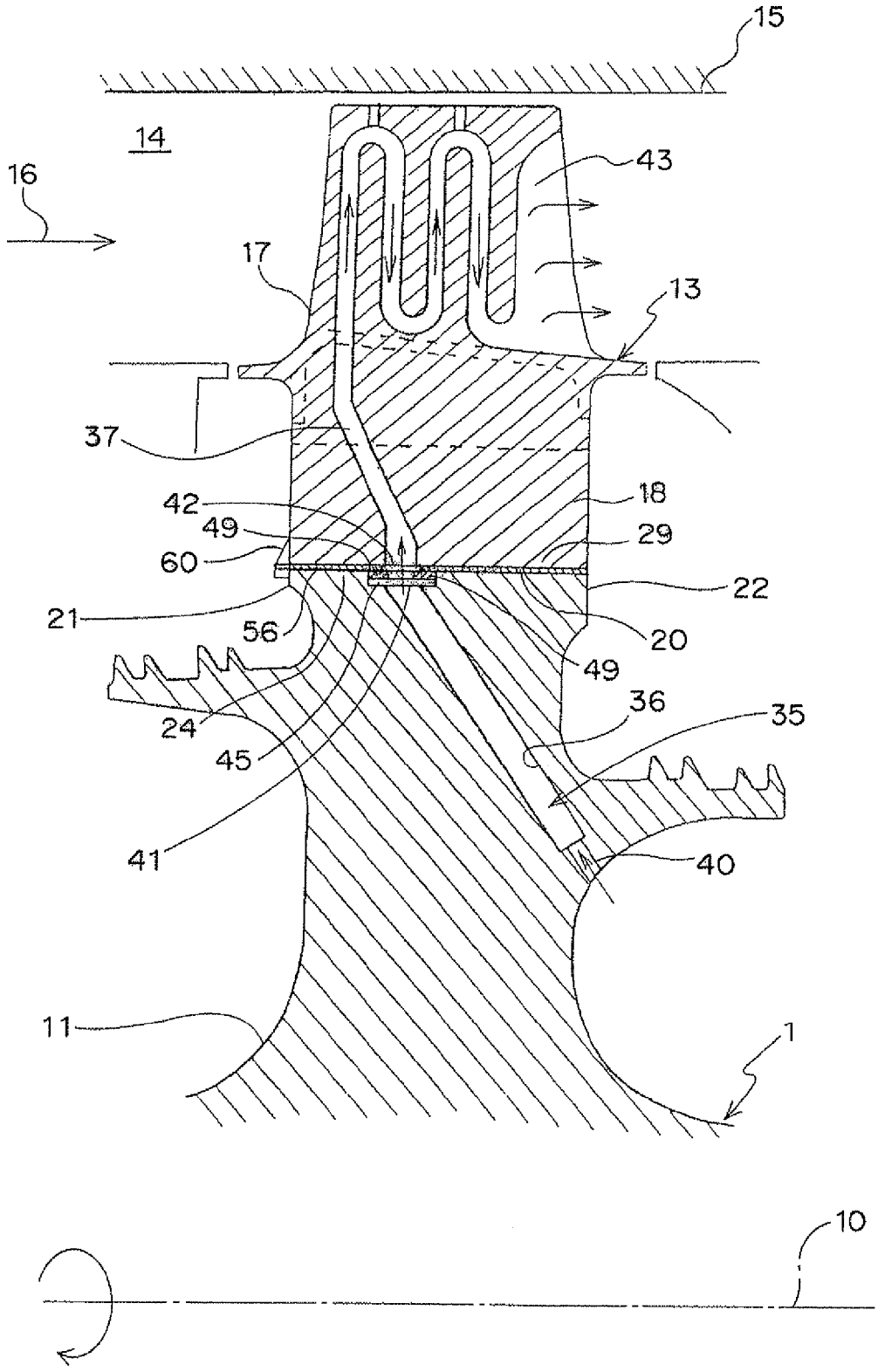
FIG. 1 is a partial cross sectional view of a gas turbine engine along a rotational axis.

FIG. 1 shows, among others, a part of the turbine generally indicated by reference numeral 1. Although not shown, the turbine 1 is supported for rotation about a central or rotational axis 10 of the gas turbine engine extending in the horizontal, left-to-right direction of the drawing. Also, the turbine 1 has a number of turbine disks 11 arranged in series along the rotational axis, but only a part of one turbine disk 11 is indicated in the drawing. The turbine disk 11 has a circumferential surface 12 extending about the rotational axis. The circumferential surface 12 supports a number of blade members, generally indicated by reference numeral 13, arranged at regular intervals in the circumferential direction. The blade members 13 are projected in an annular turbine chamber 14, defined between the turbine 1 and a cylindrical outer casing 15 fitted around the turbine 1, in which the combustion gas 16 travels from left to right in the drawing to impinge the blade members and thereby induce a rotational force of the turbine 1.

Each blade member 13 has a blade portion 17 for generating the rotational force by the impingement of the combustion gas 16 and a root portion 18 for the connection of blade member 13 to the turbine disk 11. To facilitate the connections between the turbine disk 11 and the blade members 13, the circumferential surface 12 of the turbine disk 11 has a number of grooves 20 connecting between upstream and downstream major surfaces 21 and 22 of the turbine disk 11. Although not shown in the drawings, in the exemplary embodiment each groove 20 is oriented in a direction which obliquely crosses, at a certain angle, a direction parallel to the rotational axis 10.

The groove 20 has a configuration defined by a pair of symmetric corrugated side walls 23 extending radially inwardly from the circumferential surface 12 toward the rotational axis 10 and a bottom wall 24 connecting the innermost ends of the side walls 23. The root portion 18, on the other hand, has a configuration defined by a pair of symmetric corrugated side walls 28 extending radially inwardly from the blade portion 17 and a bottom wall 29 connecting the innermost ends of the side walls 28, complementary to the side walls 23 and the bottom wall 24 of the groove 20, respectively.

In the exemplary embodiment, the corrugated side walls 23 of the groove 20 have surface portions 26 and diverging radially inwardly. Correspondingly, the corrugated side walls 28 of the root portion 18 have associated diverging surface portions 30 and 31. This allows that that each blade member 13 is assembled on the circumferential surface 12 of the turbine blade 11 simply by inserting and sliding the root portion 18 of the blade member 13 into the groove 20 from its upstream or downstream end opening.

In order to accommodate heat expansions of the turbine disk 11 and the blade member 13, as shown in the drawings, the cross sectional configuration of the root portion 18 is designed to be slightly smaller than the corresponding cross sectional configuration of the groove 20. This causes small gaps 32 between the inner walls 23 and 24 of the groove 20 and the opposed outer walls 28 and 29 of the root portion 18 fitted within the groove 20. For example, FIG. 2 shows that the blade member 13 is forced radially outwardly and, as a result, the gaps 32 are formed in large part between the wall portions of the groove 20 facing radially outwardly and the wall portions of the root portion 18 facing radially inwardly.

As best shown in FIG. 1, a cooling arrangement generally indicated by reference numeral 35 is provided for bringing cooling medium, for example, the compressed air generated by the compressor, into thermal contacts with the blade members 13 which are exposed to the high-temperature combustion gas 16 during the operation of the gas turbine engine 10.

In the exemplary embodiment, for each blade member 13 the cooling arrangement 35 has a first channel 36 defined within the turbine disk 11 and a second channel 37 defined within the blade member 13. An inlet opening 40 of the first channel 36 is provided at, for example, the downstream major surface 22 of the turbine disk 11 and an outlet opening 41 of the first channel 36 is provided at the bottom wall 24 of the groove 20. Also, an inlet opening 42 of the second channel 37 is provided at the bottom wall 29 of the root portion 18 and an outlet opening 43 of the second channel 37 is provided at the downstream surface portion of the blade portion 17. In the exemplary embodiment, the second channel 37 is alternately turned radially outwardly and inwardly to cool each and every portion of the blade portion 17.

Figure 2:
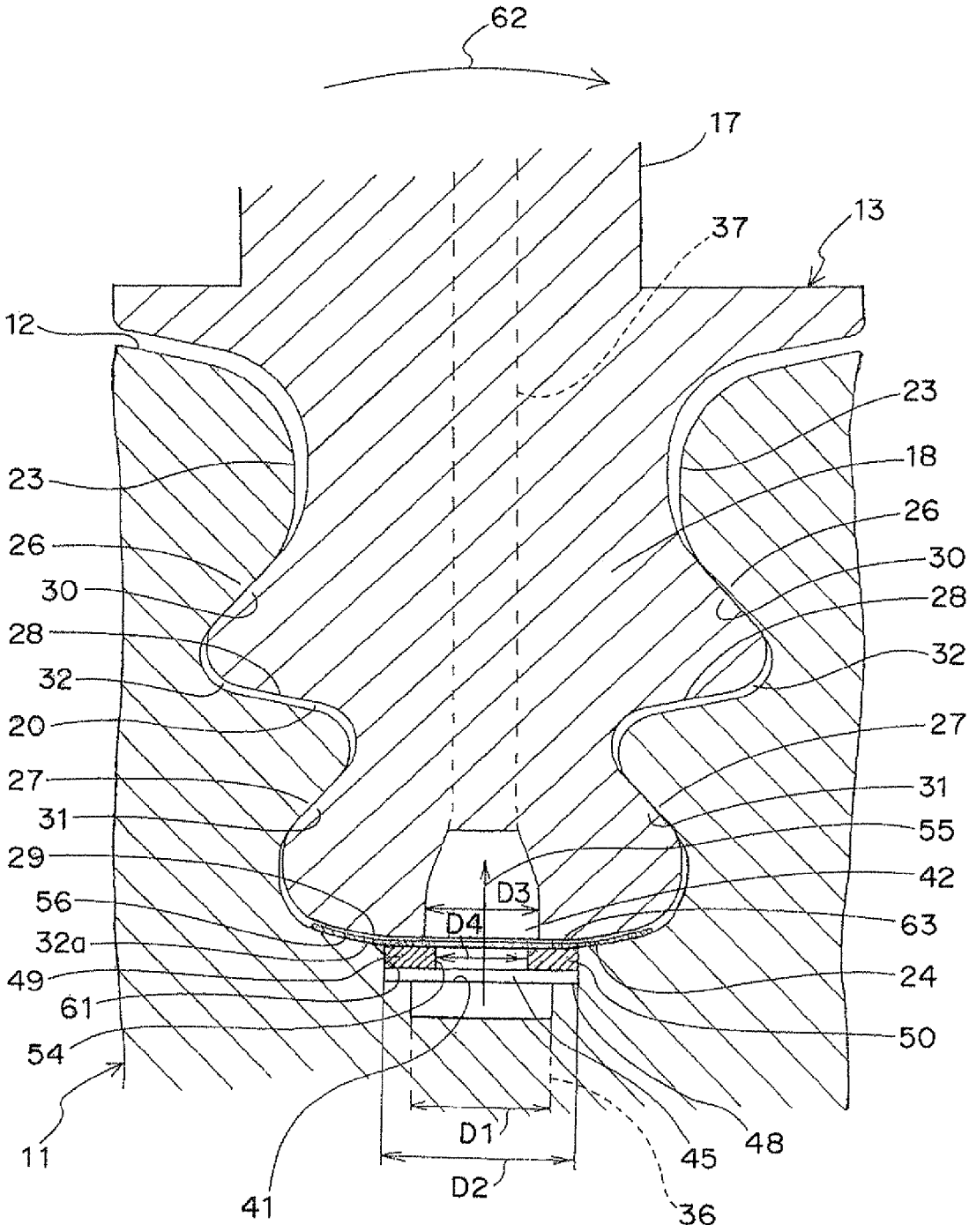
FIG. 2 is a partial cross sectional view of the gas turbine engine, showing a connection between a turbine disk and a blade member.

As can be seen from FIGS. 1 and 2, the outlet and inlet openings 41 and 42 of the first and second channels 36, 37 are positioned at approximately the center of the bottom walls 24 and 29 thereof with respect to the rotational direction and closer to the upward major surface 21 of the turbine disk 11 with respect to the central axial direction, to oppose each other in the radial direction.

Figure 3:
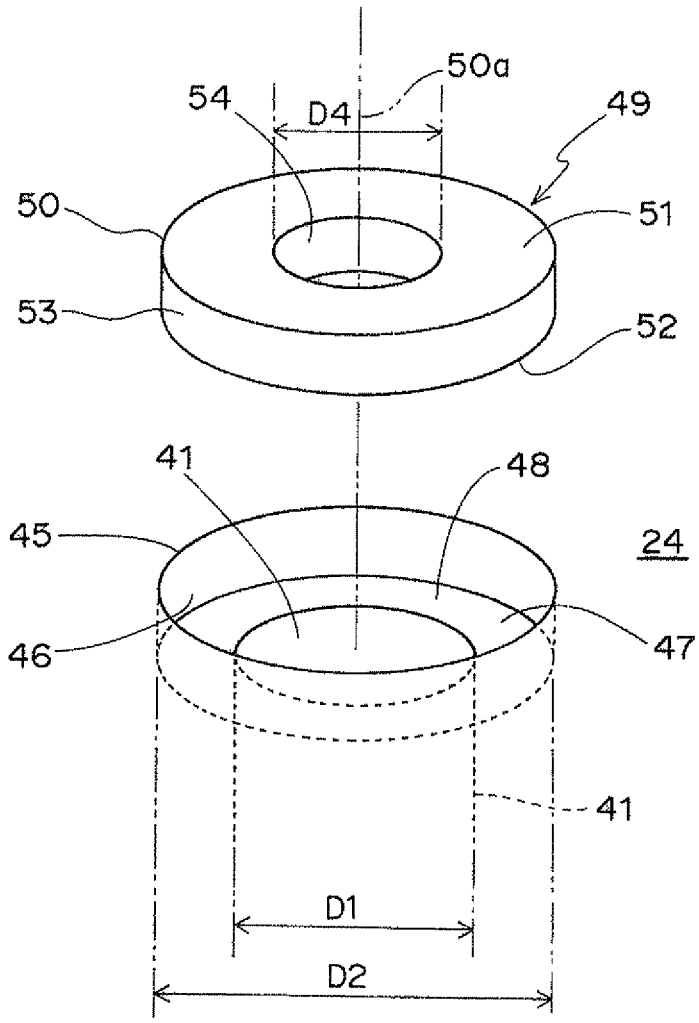
FIG. 3 is a perspective view of a sealing pad and a recess in which the sealing pad is fitted.

Also, the outlet 41 of the first channel 36 is fluidly communicated to a cavity or recess 45 defined in the bottom wall 24 of the groove 20. As best shown in FIG. 3, the recess 45 is defined by a peripheral wall or surface extending in a direction parallel to the radial direction and a bottom wall or surface 47 where the outlet 41 of the first channel 36 is opened.

Preferably, the cross sections of the outlet opening 41 of the first channel 36 and the recess 45, taken along planes running from left to right in FIG. 2, are circular and they are positioned substantially coaxially. Also, an inner diameter D2 of the recess 45 is designed to be larger than the inner diameter D1 of the outlet opening 41 of the first channel 36, defining an annular bottom wall portion or step 48 surrounding the outlet opening 41 of the first channel 36. The cross section of the opposed inlet opening 42 of the second channel 37 is designed to be circular having a diameter D3 smaller than the inner diameter D2 of the recess 45. Also, as shown in FIGS. 1 and 2, the inlet opening 42 of the second channel 37 is positioned so that, when the blade member 13 is properly assembled to the turbine disk 11, the inlet opening 42 of the second channel 37 coaxially opposes to the recess 45 and the outlet opening 40 of the first channel 36.

As best shown in FIG. 3, a sealing member 49 is mounted in the recess 45. The sealing member 49 has a first portion made of a sealing pad 50. The sealing pad 50 is configured by a pair of parallel, major surfaces 51 and and an outer peripheral wall or surface 53 extending around a central axis 50*a* and connecting the peripheral edges of the major surfaces 51 and 52. Preferably, a size or thickness of the sealing pad 50, measured top to bottom direction in the drawing is designed to be the same or smaller than the size or depth of the recess 50 measured in that direction. The cross section of the peripheral surface 53 of the sealing pad 50 is designed to be the same or substantially the same as that of the peripheral surface 46 of the recess 45. This allows that the sealing pad 50 moves within the recess 45 in its axial direction as the peripheral surface 48 of the sealing pad 50 maintains a first sealing contact with the that 46 of the recess 45.

The sealing pad 50 has a central aperture 54 extending in the central axis 50*a* between the major surfaces 51 and 52, preferably in the form of circle having a diameter D4 which is smaller than D1 and D3 (see FIG. 2) of the openings 40 and 42 of the first and second channels 36 and 37, which allows that the cooling air 55 such as air compressed by the compressor is delivered through the first channel 36 of the turbine disk 11, the aperture 54 of the sealing pad 50, and the second channel 37 of the blade member 13.

Figure 4:
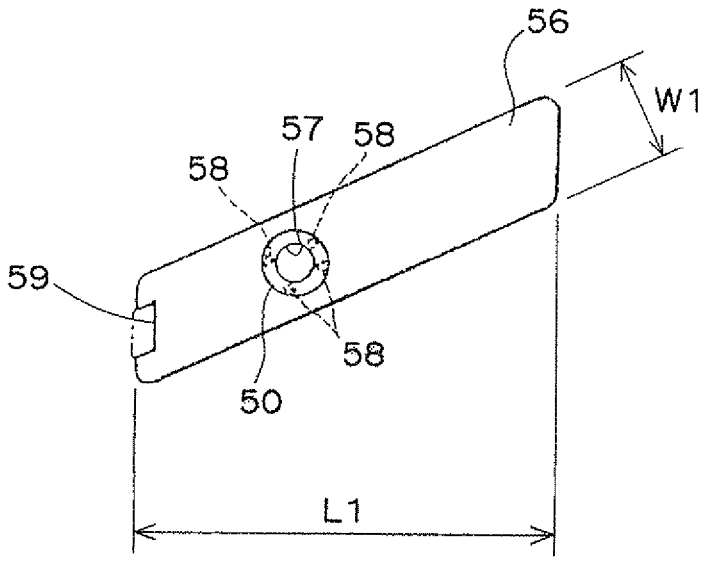
FIG. 4 is s plan view of a shim plate of the sealing member.

As shown in FIGS. 1 and 2, according to the exemplary embodiment, the sealing member 49 also has a second portion made of a shim plate 56. As best shown in FIG. 4, in the exemplary embodiment the shim plate 56 is in the form of strip. Corresponding to the fact that the groove 20 is oriented obliquely to a direction parallel to the central axis 10 of the gas turbine engine 1, the trip ends of the shim plate 56 are preferably cut obliquely in the widthwise direction. A size L1 of the shim plate 56, measured in a direction perpendicular to the strip ends, is designed to be larger than a width of the circumferential surface 12 in the direction parallel to the central axis 10, so that the upstream end of the shim plate 56 projects from the upstream end of the groove 20 and the downstream end thereof coincides with the downstream end of the groove 20 when it is properly fitted in the groove 20. Also, the shim plate 56 has a width W1 larger than the diameter of the sealing pad 50. Further, the shim plate 56 has a thickness substantially the same or smaller than the maximum size of the gap 32*a* which would be defined between the opposed bottom walls 24 and 29.

The shim plate 56 has an aperture 57 defined therein. The aperture 57, which is preferably in the form of circle, has a shape and size substantially the same or larger than the aperture 54 of the sealing pad 50 and is positioned coaxially with the aperture 54 so that the aperture 54 completely opposes an interior defined inside the aperture 57. Further, corresponding to the fact that the outlet and inlet openings 41 and 42 are positioned closer to the upstream major surface 21 of the turbine disk 11, as shown in FIG. 4 the aperture 57 is positioned closer to the upstream end of the shim plate 56 so that, when the shim plate 56 is positioned properly within the gap 32*a*, the apertures 54 and 57 are positioned coaxially with the openings 41 and 42 to fluidly communicate therebetween.

The sealing pad 50 is secured to the shim plate 56 by means of a suitable bonding means, which ensures that the major surface 51 of the sealing pad 50 makes a sealing contact with the opposed major surface of the shim plate 56 to prevent leakage of the compressed air between the opposing surfaces. Preferably, spot-welding 58 is used for the bonding, which is advantageous for preventing unwanted thermal deformations of the sealing pad and the shim plate 56. Although in the exemplary embodiment four points are spot-welded, it is not restrictive to the invention. Also, preferably the shim plate 56 is manufactured by die-cutting. Preferably, as shown in FIG. 4, an engagement notch 59 is formed at the upstream end of the shim plate 56 for the proper positioning of the sealing member 49 relative to the groove 20. For this purpose, as shown in FIG. 1, the blade member 13, in particular the root portion 18, has an associated projection 60 secured on its upward surface and projecting radially inwardly beyond the bottom wall 29 so that, when the root portion 18 of the blade member 13 is slidingly fitted in the associated groove 20, the projection 60 enters the engagement notch 59 to orient the shim plate 56 in a predetermined direction.

Preferably, the sealing pad 50 and the shim plate 56 are made of heat-resistant metal or alloy such as Ni-base superalloy IN 718. The sealing pad 50 and/or the shim plate 56 may have plural layers as described in the U.S. Pat. No. 5,160,243, the entire disclosure of which is incorporated herein by reference.

The blade members 13 and the sealing members 49 so constructed are assembled to the turbine disk 11. Specifically, first the sealing member 49 is placed in the groove 20 with the sealing pad 50 fitted in the recess 45, forming a continuous, first sealing contact 61 between the circumferential surface 46 of the recess 45 and the associated circumferential surface 53 of the sealing pad 50. In this condition, the upstream end of the shim plate 56 is projected from the upward end of the groove 20 so that the engagement notch 59 is positioned outside the groove 20.

Then, the blade member 13 is mounted on the circumferential surface 12 as the root portion 18 is slidingly fitted in the groove 20 from the upward end opening of the groove 20. When the root portion 18 of the blade member 13 is substantially completely accommodated within the groove 20, the projection 60 enters the associated engagement notch 59 to establish a mechanical engagement with the shim plate 56.

This cause that the sealing member 49 is positioned in every direction at two portions, i.e., by the sealing pad 50 and the engagement notch 59, preventing the movement and rotations of the sealing member 49 relative to the turbine disk 11. This also establishes a fluid communication between the first and second channels 36 and 37 through the aperture 54 of the sealing pad 50.

In operation of the gas turbine engine, the turbine disks 11 are driven by the impingements of the high pressure combustion gas to rotate in the rotational direction indicated in FIG. 1. This results in that, due to the centrifugal force, the blade members 13 are forced radially outwardly away from the rotational axis 10 of the turbine 1. This causes that, as shown in FIG. 2, the diverging side wall portions 30 and 31 of the root portion 18 are forcedly brought into contacts with the associated side wall portions 26 and 27 of the groove 20, which in turn forms gaps 32 between the remaining opposed wall surface portions of the root portion 18 and the groove 20. In particular, a gap 32*a* is formed between the opposed bottom walls 24 and 26 of the root portion 18 and the groove 20.

The centrifugal force is also applied to the sealing member 49 to force it radially outwardly, which results in that the sealing pad 50 moves within the recess radially outwardly as its circumferential surface 53 keeps the first sealing engagement or contact 61 with the associated circumferential surface 46 of the recess 45 and also the shim plate 56 makes a second sealing engagement or contact 63 with the bottom wall 29 of the root portion 18 surrounding the inlet opening 42 of the second channel 37. This establishes a complete sealing around the opposed outlet and inlet openings 41 and 42 of the channels 36 and 37 between the opposed bottom walls 24 and 29 of the turbine disk 11 and the blade member 13, which ensures that the cooling air 55 from the first channel 36 is delivered into the second channel 37 without making any leakage or, if any, with a minimum leakage between the turbine disk 11 and the blade member 13. This also ensures that the blade member 13 is effectively cooled by the cooling air to increase its durability.

In addition, the inner diameter of the central aperture 54 of the sealing pad 50 is smaller than those of the outlet and inlet openings 40 and 42 of the channels 36 and 37, which provides an increased hydrodynamic resistance to the flow of cooling air passing through the aperture 54. This in turn results in that the sealing pad 50 is forced by the flow of cooling air toward the blade member 13, namely, a pressure difference between the upstream and downstream sides of the sealing pad 50, to strengthen the second sealing contact 63 between the shim plate 56 and the bottom wall 29 of the blade member 13, which further ensures to prevent the cooling air from breaking the second sealing contact 63 therebetween.

Accordingly, the effective cooling of the blade members 13 is attained economically with minimum modifications of the conventional turbine, i.e., formations of the recesses and additions of the sealing pads to the shim plates.

Also, the sealing between the sealing member 49 and the turbine disk 11 is established by the sealing pad 50, not by the shim plate 56. This allows that the thickness of the shim plate 56 is far reduced than the gap 32*a*,which facilitates the fitting of the blade member into the groove. Also, the shim plates can be selected from a number of plate materials having different thicknesses and widths.

Further, the cross sectional configuration of the sealing pad 50 and the associated cross sectional configuration of the recess 45 are not limited to circle. It should be noted, however, that the circular configurations thereof facilitate the precise manufacturing of the sealing pad and the precise formation of the recess, which ensures the sealing contacts between the peripheral surface of the sealing pad and the associated peripheral surface of the recess and allows the aperture of the sealing pad to establish a stable fluid communication between outlet and inlet openings of the channels.

Furthermore, according to the invention the arrangement of the sealing member 49 within the groove 20 precedes the fitting of the blade member 13 into the groove 20, which eliminates possible troubles which would otherwise be caused by the insertion of the shim plate into the gap between the turbine disk and the blade member, such as deformations, incomplete insertion, and/or jamming of the shim plate.

Moreover, the sealing member 49 according to the embodiment is positioned precisely by the first engagement of the sealing pad 50 fitted in the associated recess 45 of the turbine disk 11 and the second engagement of the engagement notch 59 with the associated projection of the blade member 13, which prevents the sealing member 49 from displacing in any direction or rotating about the sealing pad 50 relative to the turbine disk 11 and the blade member 13.

In addition, the sealing pad 50 acts as a regulator for regulating a flow rate of cooling air to be fed into the blade member 13. This in turn means that the flow rate and the resultant cooling ability can be adjusted by using sealing pads with different inner diameters, or sizes and shapes, of the apertures.

Although the sealing pad and the shim plate are produced as separate members in the previous embodiment, they may be made integrally from a single material.

Figure 6:
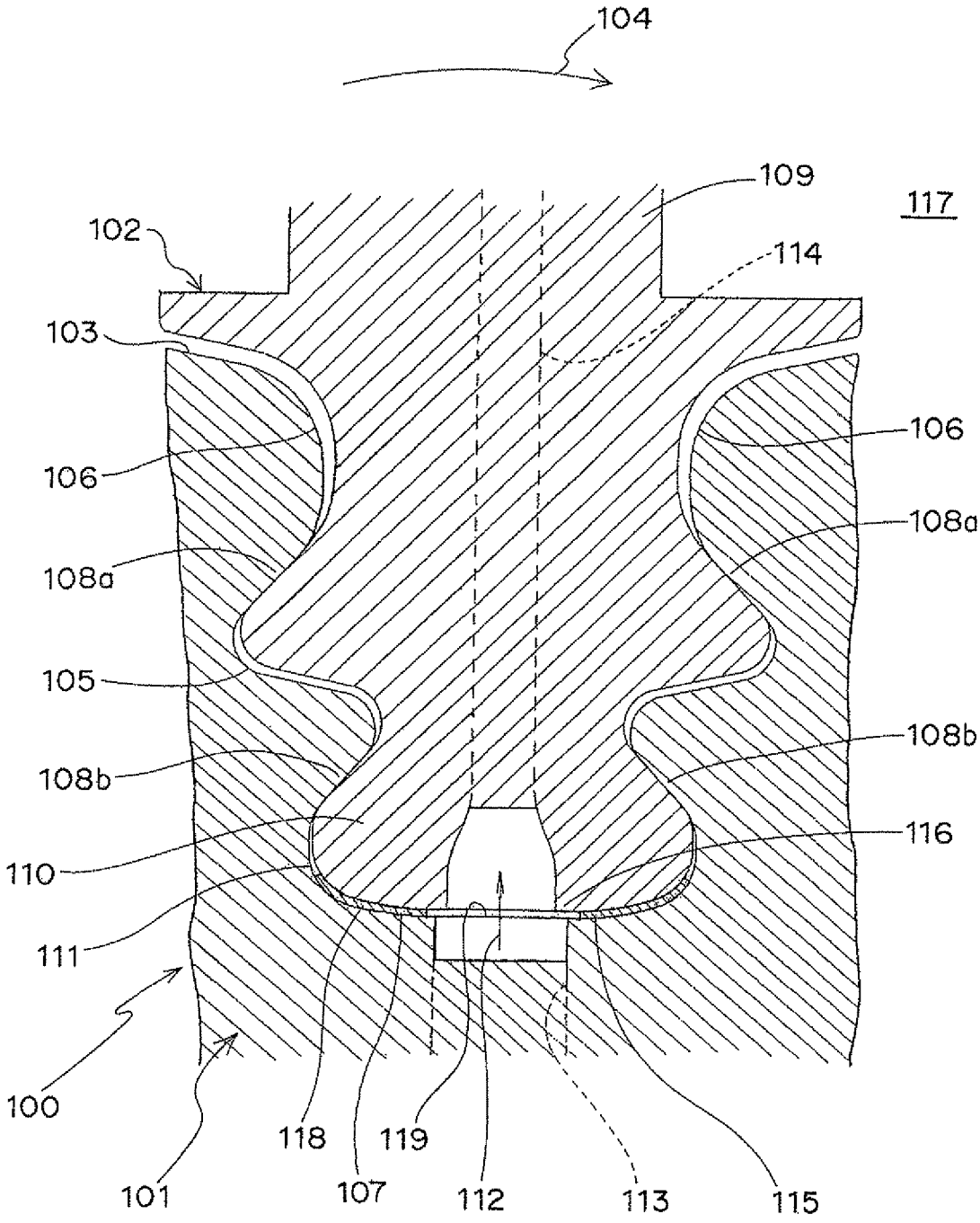
Fig.6 PRIOR ART
FIG. 6 is a partial cross sectional view of the conventional gas turbine engine.

Referring to FIG. 6, a second embodiment of the invention will be described below. As indicated in the drawing, the sealing member 149 has a sealing pad 150. Unlike the first embodiment, the sealing member 149 does not have a shim plate.

In the exemplary embodiment, preferably the bottom wall 29 of blade member 13 has an associated shallow recess 161 which surrounds the inlet opening 42 of the second channel 37 to form an annular step 162 extending continuously around the inlet opening 42. The surface of the step 162, i.e., bottom surface of the recess 161 is machined evenly so as to form a continuous second sealing contact with the radially outward major surface of the sealing pad 150. Also, an inner peripheral configuration of the recess 161 is designed to be larger than that of the outer peripheral of the sealing pad 150.

Figure 5:
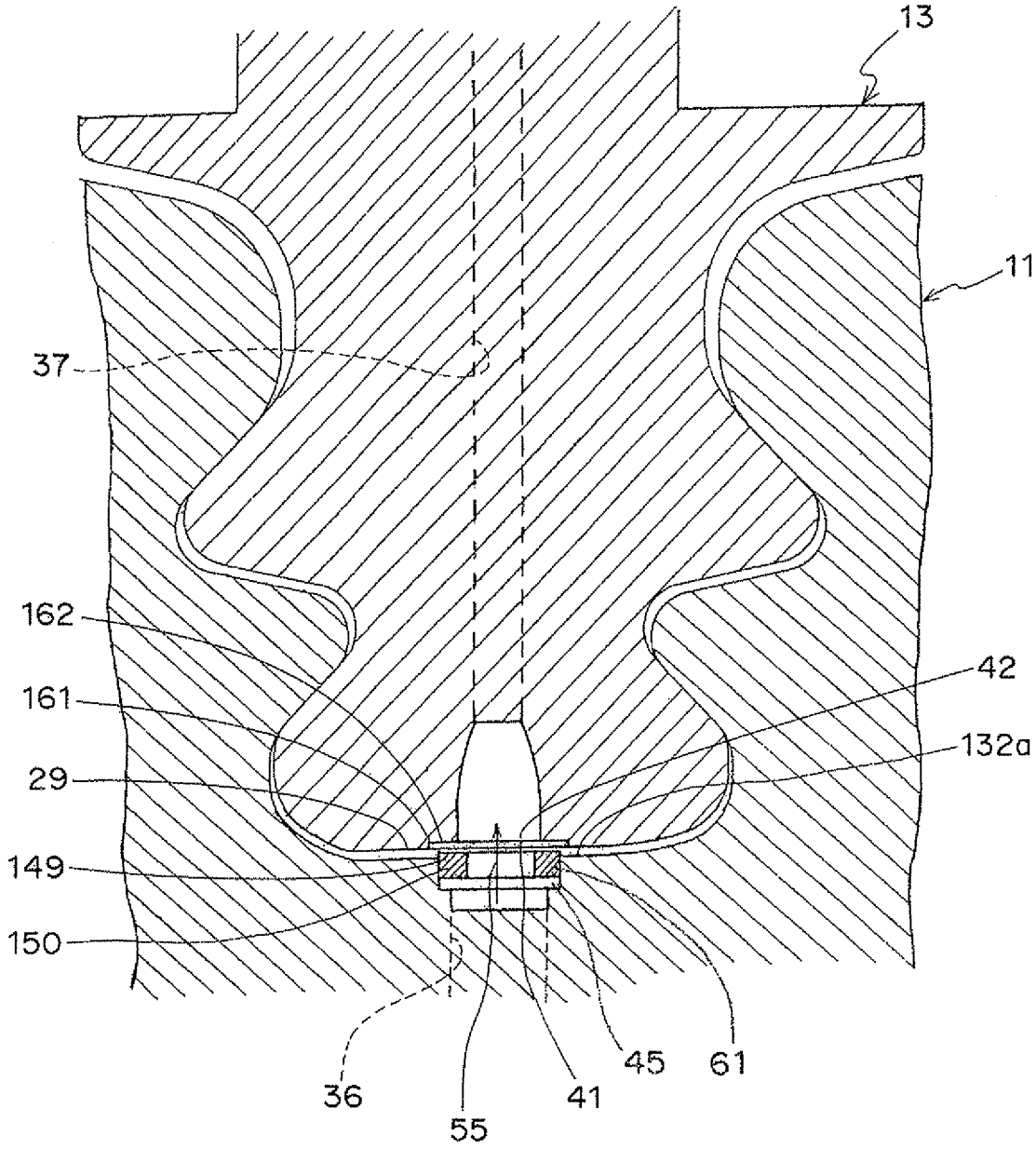
FIG. 5 is a partial cross sectional view of the gas turbine engine, showing another embodiment of the sealing member.

In the exemplary embodiment, the recess 161 is in the form of circle which is positioned coaxial with the inlet opening 42 and has a diameter substantially the same as or larger than the outer diameter of the sealing pad 150. The recess 161 has a depth or thickness so that, when a radially outward portion of the sealing pad 150 enters the recess 161 to abut the step 162 of the radially outwardly forced blade member 13 forming the maximum gap 132*a* between the opposed bottom walls 24 and 29 as shown in FIG. 5, the opposite radially inward portion of the sealing pad 150 stays within the recess 45 to maintain the first sealing contact between the peripheral surfaces of the recess 45 and the sealing pad 50. Therefore, this arrangement is available where the inlet opening 42 of the second channel 37 is smaller than the outer diameter of the sealing pad 150.

In operation of the second embodiment, due to the centrifugal force applied to the sealing pad 150 and the pressure difference between the upstream and downstream sides thereof, the sealing pad 150 is forced radially outwardly to enter the recess 161 and abut the annular step 162 to form a continuous second sealing contact 163 therebetween. Also, the sealing pad 150 maintains the first sealing contact 61 with the associated circumferential surface of the recess 49. This ensures that the cooling air is delivered from the first channel 36 into the second channel 37 without leaking into the gap 132*a* between the turbine disk 11 and the blade member 13. Therefore, the same advantages described in relation to the first embodiment are obtained in this embodiment. In addition, this embodiment does not need the shim plate, which simplifies the manufacturing of the sealing member 149.

The description of the invention is merely exemplary in nature and, thus, variations that do not depart from the gist of the invention are intended to be within the scope of the invention. Such variations are not to be regarded as a departure from the spirit and scope of the invention. In particular, although it has been described that the cross sections of the sealing pad and the associated recess have circular configurations, they may take other complementary configurations.

PARTS LIST

| | | | |
|---|---|---|---|
| 1: | turbine | 10: | rotational axis |
| 11: | turbine disk | 12: | circumferential surface |
| 13: | blade member | 14: | turbine chamber |
| 15: | casing | 16: | combustion gas |
| 17: | blade | 18: | root |
| 20: | groove | 21, 22: | major surface |
| 23: | side wall | 24: | bottom wall |
| 26, 27: | diverging surface portion | | |
| 28: | side wall | 29: | bottom wall |
| 30, 31: | surface portion | 32: | gap |
| 35: | cooling arrangement | 36: | first channel |
| 37: | second channel | 40: | inlet opening |
| 41: | outlet opening | 42: | inlet opening |
| 43: | outlet opening | 45: | recess |
| 46: | circumferential surface | | |
| 47: | bottom surface | 48: | annular step |
| 49: | sealing member | 50: | sealing pad |
| 51, 52: | major surface | 53: | circumferential surface |
| 54: | aperture | 55: | cooling air |
| 56: | shim plate | 57: | aperture |
| 58: | spot welding | 59: | engagement notch |
| 60: | projection | 149: | sealing member |
| 150: | sealing pad | 161: | recess |
| 162: | step | | |

What is claimed is:

1. An arrangement for use with a gas turbine engine, said engine has a rotational axis, a turbine disk supported for rotation about said rotational axis, and a blade member detachably mounted in a groove defined in a circumferential portion of said disk, said groove having an inwardly enlarged portion and said blade member having a root complementary to said enlarged portion so as to fit into said groove, said disk and said blade member have first and second channels fluidly communicated to each other through first and second openings defined in radially opposed first and second wall portions of said groove and said root, comprising:

a sealing member having a first portion, said first portion having a central axis, a first peripheral surface extending in a direction parallel to said central axis, and a central aperture extending in said central axis;

said first wall portion of said groove having a first recess defined therein and fluidly communicated with said first opening of said first channel, said first recess having a second peripheral surface complementary to said first peripheral surface of said first portion of said sealing member for receiving said first portion of said sealing member, whereby said first portion of said sealing member moves radially toward and away from said rotational axis as said first peripheral surface of said sealing member defines and maintains a first sealing contact with said second peripheral surface of said first recess, when a centrifugal force is applied to said sealing member, said sealing member moves radially outwardly to abut said second wall portion of said root and thereby make a second sealing contact surrounding said second opening of said second channel to establish a sealed fluid communication between said first and second openings through said aperture, wherein the sealing member has a second portion extending between said opposed first and second wall portions and surrounding said aperture, said second portion having a length which is larger than a width of said opposed first and second wall portions in a direction parallel to the rotational axis so that one end of the second portion can project from one end of the groove and the other end of the second portion coincides with the other end of the groove;

wherein said second portion abuts said second bottom wall portion of said root and makes said second seal contact therewith when said centrifugal force is applied to said sealing member, wherein said second portion of said sealing member is made of a plate, said plate being sealingly attached to said first portion of said sealing member, wherein said second portion of said sealing member has an engaging portion which positions outside said groove, and said blade member has an associated engaging projection corresponding to said engaging notch of said sealing member so that, when said sealing member is placed between said opposed first and second wall portions with said first portion of said sealing member fitted in said first recess, said engaging notch of said blade member engages with said engaging projection of said second portion to prevent a rotation of said sealing member and retain said sealing member in position.

2. The arrangement of claim 1, wherein said aperture has a diameter smaller than that of said first opening.

3. The arrangement of claim 1, wherein said second wall portion of said blade member has a second recess fluidly communicated with and surrounding said second opening of said second channel, said second recess having a bottom wall portion to which said sealing member abuts and makes said second sealing contact.

4. A gas turbine engine comprising a rotational axis, a turbine disk supported for rotation about said rotational axis, and a blade member detachably mounted in a groove defined in a circumferential portion of said disk, said groove having an inwardly enlarged portion and said blade member having a root complementary to said enlarged portion so as to fit into said groove, said disk and said blade have first and second channels fluidly communicated to each other through first and second openings defined in radially opposed first and second wall portions of said groove and said root, comprising a sealing arrangement, said arrangement having a sealing member having a first portion, said first portion having a central axis, a first peripheral surface extending in a direction parallel to said central axis, and a central aperture extending in said central axis;

said first wall portion of said groove having a first recess defined therein and fluidly communicated with said first opening of said first channel, said first recess having a second peripheral surface complementary to said first peripheral surface of said first portion of said sealing member for receiving said first portion of said sealing member, whereby said first portion of said sealing member moves radially toward and away from said rotational axis as said first peripheral surface of said sealing member defines and maintains a first sealing contact with said second peripheral surface of said first recess, when a centrifugal force is applied to said sealing member, said sealing member moves radially outwardly to abut said second wall portion of said root and thereby make a second sealing contact surrounding said second opening of said second channel to establish a sealed fluid communication between said first and second openings through said aperture, wherein the sealing member has a second portion extending between said opposed first and second wall portions and surrounding said aperture, said second portion having a length which is larger than a width of said opposed first and second wall portions in a direction parallel to the rotational axis so that one end of the second portion can project from one end of the groove and the other end of the second portion coincides with the other end of the groove;

wherein said second portion abuts said second bottom wall portion of said root and makes said second seal contact therewith when said centrifugal force is applied to said sealing member, wherein said second portion of said sealing member is made of a plate, said plate being sealingly attached to said first portion of said sealing member, wherein said second portion of said sealing member has an engaging portion which positions outside said groove, and said blade member has an associated engaging projection corresponding to said engaging notch of said sealing member so that, when said sealing member is placed between said opposed first and second wall portions with said first portion of said sealing member fitted in said first recess, said engaging notch of said blade member engages with said engaging projection of said second portion to prevent a rotation of said sealing member and retain said sealing member in position.

* * * * *